US011576238B2

(12) United States Patent
Hsieh et al.

(10) Patent No.: US 11,576,238 B2
(45) Date of Patent: Feb. 7, 2023

(54) VIRTUAL TEMPERATURE-SENSOR FOR ACTIVE THERMAL-CONTROL OF A LIGHTING SYSTEM HAVING AN ARRAY OF LIGHT-EMITTING DIODES

(71) Applicant: Google LLC, Mountain View, CA (US)

(72) Inventors: Duen Hsing Hsieh, Taipei (TW); Ihab A. Ali, Cupertino, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/181,139

(22) Filed: Feb. 22, 2021

(65) Prior Publication Data

US 2022/0272804 A1 Aug. 25, 2022

(51) Int. Cl.
*H05B 45/18* (2020.01)
*H05B 45/60* (2022.01)
*H05B 45/14* (2020.01)

(52) U.S. Cl.
CPC ..... *H05B 45/18* (2020.01); *H05B 45/14* (2020.01); *H05B 45/60* (2020.01)

(58) Field of Classification Search
CPC ..... H05B 45/18; H05B 45/14; H05B 45/60
See application file for complete search history.

(56) References Cited

U.S. PATENT DOCUMENTS

| | | | | |
|---|---|---|---|---|
| 11,272,591 | B1 * | 3/2022 | Lee | H02H 3/087 |
| 2007/0171159 | A1 | 7/2007 | Lee | |
| 2012/0105228 | A1 | 5/2012 | Loveland et al. | |
| 2012/0181931 | A1 * | 7/2012 | Katsura | H05B 45/325 315/77 |
| 2013/0200813 | A1 | 8/2013 | Wang et al. | |

FOREIGN PATENT DOCUMENTS

KR 101221492 1/2013

* cited by examiner

*Primary Examiner* — Daniel D Chang
(74) *Attorney, Agent, or Firm* — Colby Nipper PLLC

(57) ABSTRACT

This document describes systems and techniques that use a virtual temperature-sensor for active thermal-control of a lighting system having an array of LEDs. The system and techniques use a forward voltage across the array of LEDs as the virtual temperature-sensor, converting the forward voltage to a level that is detectable by an MCU of the lighting system. In response to determining that the forward voltage exceeds a threshold, the lighting system may reduce an amount of an electrical current provided to the array of LEDs to decrease the forward voltage and alleviate a thermal condition that may be detrimental to the array of LEDs, thereby maintaining luminance capabilities of the array of LEDs and prolonging life of the array of LEDs.

20 Claims, 5 Drawing Sheets

VIRTUAL TEMPERATURE-SENSOR FOR ACTIVE THERMAL-CONTROL OF A LIGHTING SYSTEM HAVING AN ARRAY OF LIGHT-EMITTING DIODES

BACKGROUND

Light-emitting diodes (LEDs) are temperature-sensitive devices whose luminance and useful life may be affected by operation at elevated temperatures. For example, a 60-degree Celsius (° C.) increase in a temperature of an LED can degrade luminance by 10%. As another example, a 10° C. increase in the temperature of the LED may reduce a useful life of the LED by 50%.

In certain lighting systems, such as a floodlight including a printed circuit board (PCB) populated with an array of LEDs, active thermal-control to maintain luminance and prolong life of the array of LEDs may pose multiple challenges. For instance, an active thermal-control system of the floodlight may include instrumentation that uses a negative temperature coefficient (NTC) thermistor attached to, or embedded within, the PCB to measure a temperature of the array of LEDs. This instrumentation may require additional electrical connections for signaling between the NTC thermistor and a microcontroller (MCU) that controls power activating the LEDs, adding to expense and complexity of the floodlight. Readings from the instrumentation may also represent a temperature of the PCB as opposed to a junction temperature of one or more of the LEDs included in the array of LEDs.

Furthermore, variances in LED manufacturing processes may yield individual LEDs with differing forward voltage activation levels needed to illuminate the LEDs. In such an instance, and due to LEDs having an inherent relationship between forward voltage and junction temperature, a large temperature variance may manifest across the array of LEDs while they are under power. This large temperature variance may (i) make choosing a location for the NTC thermistor to measure a temperature of the array of LEDs difficult and/or (ii) render a single temperature measurement of the array of LEDs by the NTC thermistor moot.

SUMMARY

This document describes systems and techniques that use a virtual temperature-sensor for active thermal-control of a lighting system having an array of LEDs. The system and techniques use a forward voltage across the array of LEDs as the virtual temperature-sensor, converting the forward voltage to a level that is detectable by an MCU of the lighting system. In response to determining that the forward voltage exceeds a threshold, the lighting system may reduce an amount of an electrical current provided to the array of LEDs to decrease the forward voltage and alleviate a thermal condition that may be detrimental to the array of LEDs, thereby maintaining luminance capabilities of the array of LEDs and prolonging a life of the array of LEDs.

Although described in the context of an active thermal-control system for a floodlight, the described systems and techniques are applicable to a wide variety of lighting systems that may use an array of LEDs (e.g., a backlight for a television monitor, a headlamp for an automobile, a streetlight). Furthermore, and in addition to being used for active thermal-control in a field-use environment, the described systems and techniques may be used in a lab environment to characterize thermal aspects of a lighting system. In such a lab environment, the systems and techniques may avoid inaccuracies and errors that are introduced through conventional techniques that rely on fixing thermal measurement devices (e.g., gluing NTC thermistors, gluing thermocouples) across the array of LEDs.

In some aspects, a method is described. The method, performed by a lighting system, includes providing, by a power supply of the lighting system, an amount of an electrical current through an array of LEDs that effectuates a forward voltage across the array of LEDs. The method further includes determining, by a processor of the lighting system based on (i) the amount of the electrical current and (ii) a conversion of the forward voltage by a voltage-divider circuit, that a magnitude of the forward voltage exceeds a threshold. The method continues, and includes directing, by the processor in response to determining that the magnitude of the forward voltage exceeds a threshold, the power supply to reduce the amount of electrical current provided through the array of light-emitting diodes to (i) decrease the magnitude of the forward voltage effectuated across the array of LEDs and (ii) alleviate a thermal condition of the lighting system proximate to the array of LEDs.

In other aspects, a lighting system is described. The lighting system includes an array of LEDs, a power supply, a voltage-divider circuit, at least one thermistor, a microcontroller, and a computer-readable storage medium (CRM) storing a thermal-control manager application. The thermal-control manager application includes executable instructions that, upon execution by the microcontroller, direct the lighting system to perform operations that include (i) providing, using the power supply, an amount of an electrical current through the array of LEDs and (ii) determining a presence of a first thermal condition that is proximate to the array of light-emitting diodes, where the determination is based, in part, on a conversion of a forward voltage across the array of light-emitting diodes by the voltage-divider circuit. The operations also include (iii) assessing, based on a temperature detected by the at least one thermistor, a second thermal condition and (iv) based on the first thermal condition and the second condition, adjusting the electrical current to effectuate a change in at least the first thermal condition.

In yet other aspects, a CRM is described. The CRM includes executable instructions that, upon execution by a microcontroller, direct a lighting system to (i) provide an amount of an electrical current across an array of light-emitting diodes, the electrical current effectuating a forward voltage across the array of light-emitting diodes, (ii) determine, based on the amount of electrical current and on a conversion of the forward voltage by a voltage-divider circuit, that a magnitude of the forward voltage exceeds a threshold, and (iii) in response to the determination that the magnitude of the forward voltage exceeds the threshold, reduce the amount of the electrical current provided through the array of light-emitting diodes to decrease the magnitude of the forward voltage across the array of light-emitting diodes.

The details of one or more implementations are set forth in the accompanying drawings and the following description. Other features and advantages will be apparent from the description, the drawings, and the claims. This summary is provided to introduce subject matter that is further described in the Detailed Description. Accordingly, a reader should not consider the summary to describe essential features nor limit the scope of the claimed subject matter.

BRIEF DESCRIPTION OF THE DRAWINGS

The details of one or more aspects of a virtual temperature-sensor for active thermal-control of a lighting system having an array of LEDs are described below. The use of the same reference numbers in different instances in the description and the figures indicate similar elements.

DETAILED DESCRIPTION

Overview

Figure 1:
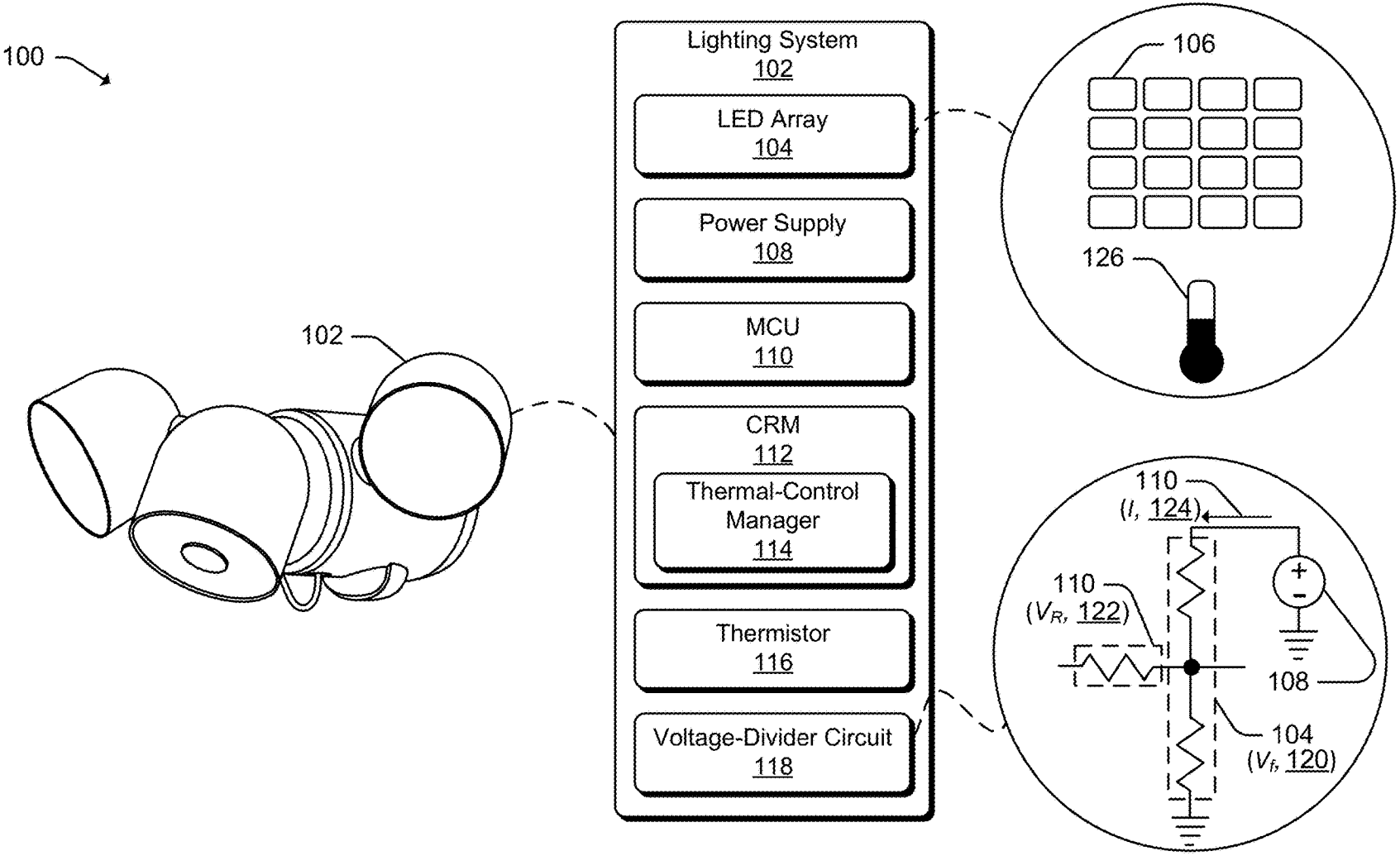
FIG. 1 illustrates an example operating environment in which active thermal-control of a lighting system having an array of LEDs can be implemented.

This document describes systems and techniques that use a virtual temperature-sensor for active thermal-control of a lighting system having an array of LEDs. The system and techniques use a forward voltage across the array of LEDs as the virtual temperature-sensor, converting the forward voltage to a level that is detectable by an MCU of the lighting system. In response to determining that the forward voltage exceeds a threshold, the lighting system may reduce an amount of an electrical current provided to the array of LEDs to decrease the forward voltage and alleviate a thermal condition that may be detrimental to the array of LEDs, thereby maintaining luminance capabilities of the array of LEDs and prolonging life of the array of LEDs.

LEDs, in general, are temperature-sensitive devices whose luminance and useful life may be affected by operation at elevated temperatures. To manage temperatures of one or more LEDs within a lighting system, an active thermal-control system of the lighting system may rely on one of several quantifiable and related temperature-performance characteristics.

In general, and for a given amount of an electrical current, linear regression analysis may be used to quantify temperature and voltage of an LED in accordance with equation (1) below:

$$T=\alpha V_f+\beta \tag{1}$$

For equation (1), T represents a junction temperature (e.g., in ° C.) of the LED, $\alpha$ represents a first constant obtained through linear regression analysis, $V_f$ represents a forward voltage (e.g., a forward operating voltage in Volts, or V) of the LED, and $\beta$ represents a second constant obtained through linear regression analysis.

Expanding the general relationship of equation (1) to address an individual LED within an array of LEDs yields equation (2) below:

$$T_i=\alpha_i V_i+\beta_i;\ \text{where } \alpha_i=\alpha+\varepsilon_i \text{ and } \beta_i=\beta+\xi_i \tag{2}$$

For equation (2), $T_i$ represents a junction temperature (e.g., in ° C.) of the individual LED, $\alpha_i$ represents a variable associated with the individual LED, $V_i$ represents a forward voltage (e.g., a forward operating voltage in V) of the individual LED, and $\beta_i$ may represent an additional variable associated with the individual LED. The variable $\alpha_i$ may sum a first predetermined constant $\alpha$ with an error term $\varepsilon_i$. The additional variable $\beta_i$ may sum a second predetermined constant $\beta$ with another error term $\xi_i$. In general, the error terms ($\varepsilon_i$, $\xi_i$) may be associated with variances within a population of LEDs.

A representative junction temperature of an array of LEDs within a lighting system (e.g., a representative junction temperature of an array of LEDs that includes one or more individual LEDs) is derivable using aspects of equation (2). Such a representative junction temperature can be quantified by equation (3) below:

$$T_{avg}=\frac{\alpha}{n}V_f+\beta+\frac{1}{n}\left(\sum_i^n \varepsilon_i V_i+\sum_i^n \xi_i\right) \tag{3}$$

For equation (3), $T_{avg}$ represents the average junction temperatures of the array of LEDs (e.g., in ° C.). The array of LEDs includes a quantity of n individual LEDs. In general, given the combination of constants, forward voltages, and error terms described in equations (2) and (3) above, $T_{avg}$ may be computed using a forward voltage $V_f$ (e.g., in V) that may be measurable across the array of LEDs. In such an instance, the forward voltage $V_f$ may serve as a virtual temperature-sensor (e.g., a temperature proxy) for the array of LEDs.

In accordance with equations (1), (2), and (3), an active thermal-control system of a lighting system may assess the representative junction temperature of the LED array by measuring $V_f$. If the measured $V_f$ exceeds a threshold (e.g., a forward voltage threshold corresponding to a maximum allowable junction temperature or thermal condition), the active thermal-control system may responsively reduce power to the array of LEDs within the lighting system, thereby reducing the forward voltage to alleviate the thermal condition.

By using the measured forward voltage $V_f$ for a temperature proxy, the lighting system may avoid using one or more NTC thermistors and realize a reduction in complexity and expense. Additionally, a more-accurate representation of junction temperature(s) (of an LED or an array of LEDs) may be realized, leading to a prolonged useful life of the lighting system.

The discussion below first describes an example operating environment and system, followed by example LED virtual sensor techniques, and followed by an example method. The discussion may generally apply to using a virtual temperature-sensor for active thermal-control of a lighting system having an array of LEDs.

Example Operating Environment and System

FIG. 1 illustrates an example operating environment 100 in which active thermal-control of a lighting system 102 having an array of LEDs (e.g., an LED array 104) can be implemented. Although FIG. 1 illustrates the lighting system 102 as a floodlight, the lighting system 102 may be a backlight for a television monitor, a headlamp for an automobile, a streetlight, and so on.

The LED array 104 includes one or more LED(s) 106. As examples, the LED 106 may be a gallium-nitride on silicon (GaN-on-Si) LED or an organic LED (OLED). In some instances, the LED 106 may also be a bare die or packaged surface mount (SMT) package component. In general, the LED 106 may be mounted to a substrate (e.g., mounted to a multi-layer PCB, a ceramic material, a silicon material).

In some instances, the lighting system 102 may include multiples of the LED array 104. For instance, the lighting system 102 may include two or more lamps aligning or pointing in separate, respective directions. Each lamp may include an instance of the LED array 104.

In some instances, each of the LED(s) 106 may conform to a common "bin" resultant from manufacturing variances (e.g., may possess common characteristics such as forward voltage, luminosity, or color temperature). In other instances, one or more of the LED(s) 106 may conform to different, respective bins.

Although illustrated as a rectangular pattern (e.g., a "4×4" matrix), the LED array 104 may be a linear pattern, a radial pattern, and so on. In some instances, the LED(s) 106 in the LED array 104 may form an electrical series (e.g., electrically couple, sequentially, in an electrical series).

The lighting system 102 further includes a power supply 108 and a microcontroller (MCU) 110. In some instances, the MCU 110 may include instrumentation (e.g., a voltmeter, an ammeter) that may be used to measure an electrical voltage (e.g., in V) and/or an electrical current in milliamperes (e.g., in mA).

The lighting system 102 further includes a computer-readable storage medium (CRM) 112. In the context of this discussion, the CRM 112 of the lighting system 102 is a hardware-based storage media, which does not include transitory signals or carrier waves. As an example, the CRM 112 may include one or more of a read-only memory (ROM), a Flash memory, a dynamic random-access memory (DRAM), a static random-access memory (SRAM), a disk-drive, a magnetic medium, and so on.

The CRM 112 may store a thermal-control manager application 114 that includes executable code or instructions. Upon execution by the MCU 110 (or another logic device), the thermal-control manager application 114 may direct the lighting system 102 to perform operations as described further below.

The lighting system 102 may also include at least one thermistor 116 (e.g., an NTC thermistor). Although not used by the lighting system 102 to directly detect junction temperatures(s) of the LED array 104 (e.g., one or more of the LEDs 106), the thermistor may be used to detect another temperature that may be pertinent to thermal control of the lighting system 102.

For example, the thermistor 116 may be included on a PCB that includes passive infrared (PIR) sensors used for motion detection (e.g., to activate the lighting system 102 based on a motion detected proximate to the lighting system 102). As another example, the thermistor 116 may be included as part of (e.g., mounted to, embedded within) another PCB to which the MCU 110 is mounted. In some instances, the thermistor 116 may be used to detect a temperature of another component of lighting system 102 (e.g., other than a temperature of the LED array).

In other instances, the thermistor 116 may be included as part of (e.g., mounted to, embedded within) a housing of the lighting system 102. In such instances, the thermistor 116 may detect, or serve as a proxy, for an ambient temperature interior to or exterior to the housing of the lighting system 102.

As illustrated in FIG. 1, the lighting system 102 may include one or more features (e.g., traces, interconnects) to form a voltage-divider circuit 118. The voltage-divider circuit 118 may electrically couple the LED array 104, the power supply 108, and the MCU 110. The voltage-divider circuit 118 may convert a forward voltage 120 (e.g., $V_f$, across the LED array 104) to a reduced voltage 122 (e.g., $V_R$) that is measurable by instrumentation of the MCU 110. In general, the forward voltage 120 may be effectuated across the LED array 104 by an electrical current 124 (e.g., I) generated by the power supply 108.

For example, if the forward voltage 120, as realized across the LED array 104, ranges between approximately 45-47V, the voltage-divider circuit 118 may linearly convert (e.g., scale) the forward voltage 120 to a voltage within a detectable level that ranges between approximately 3-5V (e.g., instrumentation of the MCU 110 may be capable of detecting the reduced voltage 122 in a range between approximately 3-5V).

In the environment 100, and under a powered condition, the LED array 104 may experience a thermal condition 126 (e.g., a junction temperature of the LED array 104 that may be detrimental to operability of the LED array 104). Using algorithms founded in equations (1)-(3) as described above, the thermal-control manager application 114 (e.g., the MCU 110 executing the thermal-control manager application 114) may determine for an amount of an electrical current supplied by the power supply 108 to the LED array 104 (e.g., an amount of the electrical current 124) that the forward voltage 120 exceeds a threshold (e.g., a threshold of the forward voltage 120 corresponding to the thermal condition 126). In such an instance, the thermal-control manager application 114 may direct the power supply 108 to reduce the electrical current 124 supplied to the LED array 104, effective to reduce the forward voltage 120 across the LED array 104 (and alleviate the thermal condition 126).

The thermistor 116 may detect a temperature (e.g., a temperature of an interior environment the lighting system 102, a temperature of an exterior environment of the lighting system 102, or a temperature of a PCB including the MCU 110). In such an instance, the thermal-control manager application 114 may assess second thermal condition based on the detected temperature (e.g., the interior environment exceeds a temperature threshold, a temperature of the exterior environment is rapidly increasing, a temperature impacting the MCU 110 exceeds a temperature threshold).

Based on the combination of the first thermal condition (e.g., the thermal condition 126) and the second thermal condition, the thermal-control manager application 114 may direct the power supply 108 to reduce the electrical current 124 provided to the LED array 104 to effectuate a change in at least the thermal condition 126 (e.g., reduce junction temperature(s) of the LED array 104). Reducing the electrical current 124 provided to the LED array 104 may also, in some instances, have concomitant effects and effectuate a change in the other, second thermal condition (e.g., lower the temperature of the interior environment of the lighting system 102, reduce a temperature of the PCB including the MCU 110).

In general, algorithms within the thermal-control manager application 114 may combine and/or superimpose thermal-control techniques that use the forward voltage 120 as a virtual temperature-sensor with additional thermal-control techniques that use the thermistor 116. Different combinations of the thermal-control techniques may be tailored to implement a desired, active-thermal-control system within the lighting system 102.

As an example, the thermal-control manager application 114 may include algorithms that are preventative. Such algorithms, which may be based on a transient thermal-response behavior of the lighting system 102 that is either modeled or characterized in a lab environment, may rely on the reduced voltage 122, as well as a temperature detected by the thermistor 116 (or multiple temperatures detected by multiple instances of the thermistor 116). In such instances, reducing the electrical current 124 provided to the LED array 104 may prevent a thermal-runaway condition.

Elements of the lighting system 102 may be discrete. For example, the power supply 108, the MCU 110, and the CRM 112 (including the thermal-control manager application 114) may, in some instances, each be included as part of a discrete, integrated circuit (IC) die (e.g., discrete IC logic die, IC memory die).

Elements of the lighting system 102 may also be combinable. For instance, the MCU 110 and the CRM 112 (including the thermal-control manager application 114) may be combined onto a system-on-chip (SoC) IC die. In such an instance, the SoC IC die may include portions of the power supply and/or the voltage-divider circuit 118.

Figure 2:
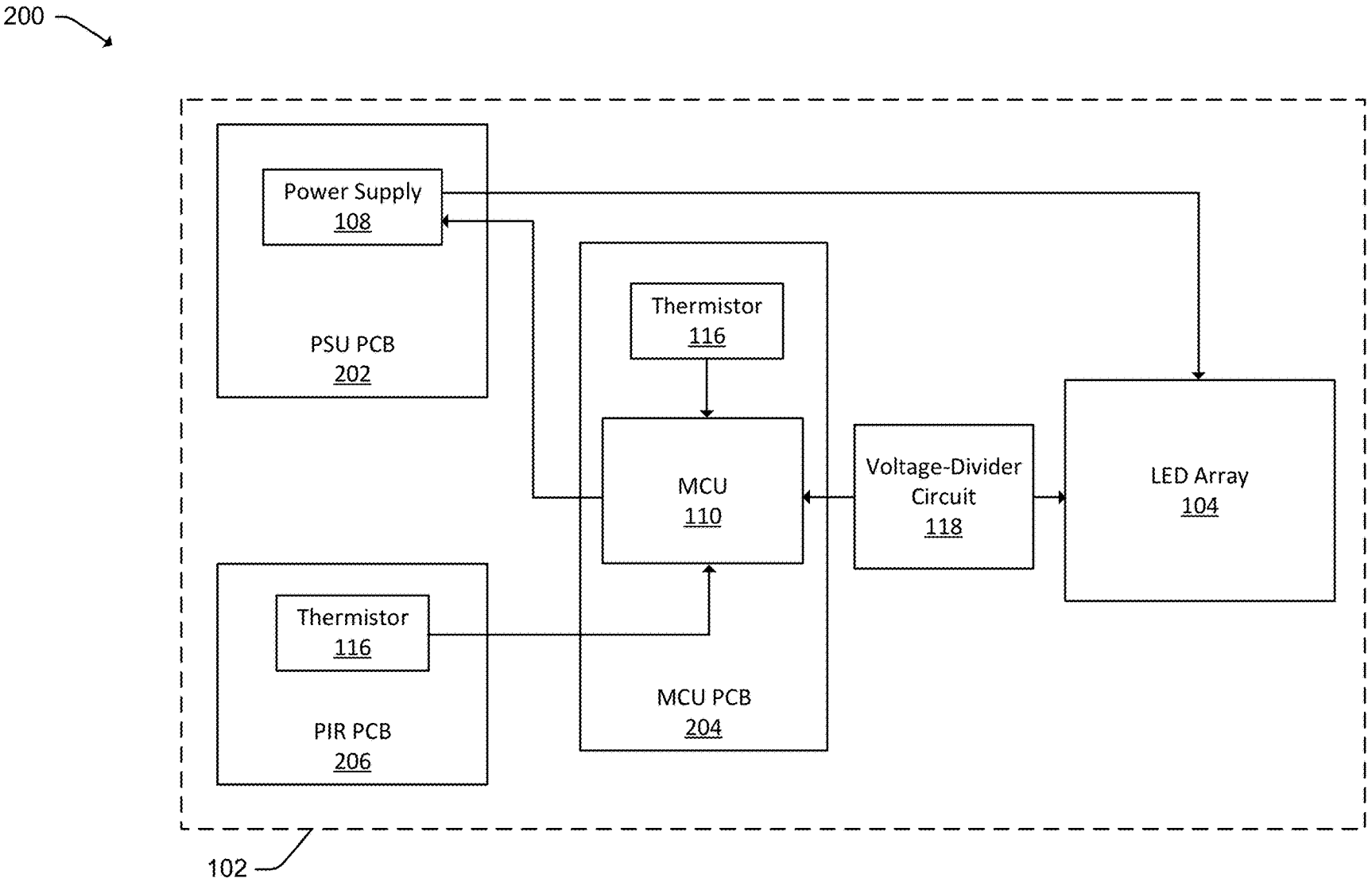
FIG. 2 illustrates an example block diagram of a lighting system having an array of LEDs and in which active thermal-control can be implemented.

FIG. 2 illustrates an example block diagram 200 of a lighting system having an array of LEDs and in which active thermal-control can be implemented. The example block diagram 200 may, in some instances, correspond to the lighting system 102 of FIG. 1.

As illustrated in FIG. 2, the block diagram 200 includes the LED array 104, the power supply 108 as part of a power supply unit (PSU) PCB 202, and the MCU 110 as part of an MCU PCB 204. The block diagram 200 also includes multiple instances of the thermistor 116, including a first instance of the thermistor 116 that is part of a PIR PCB 206 and a second instance of the thermistor 116 that is part of the MCU PCB 204. The block diagram also includes the voltage-divider circuit 118.

Signaling throughout the block diagram, as illustrated, includes the MCU 110 providing control signals to the power supply 108 (e.g., to adjust a current of the power supply) and the thermistor(s) 116 providing signaling to the MCU 110 (e.g., to provide indication(s) of temperatures(s) of the PIR PCB and/or the MCU PCB).

As illustrated, the power supply may provide an electrical current to the LED array 104. Also, the LED array 104 may be connected to the MCU 110 through the voltage-divider circuit 118. The block diagram also includes the voltage-divider circuit 118 that may pass a portion of an electrical current (e.g., a portion of the electrical current 124 of FIG. 1) from the LED array 104 to the MCU 110.

In accordance with the block diagram 200, a thermal-control manager application (e.g., the thermal-control manager application 114 of FIG. 1 being executed by the MCU 110) may actively control thermal performance of the lighting system 102.

Example LED Virtual Sensor Techniques

Figure 3:
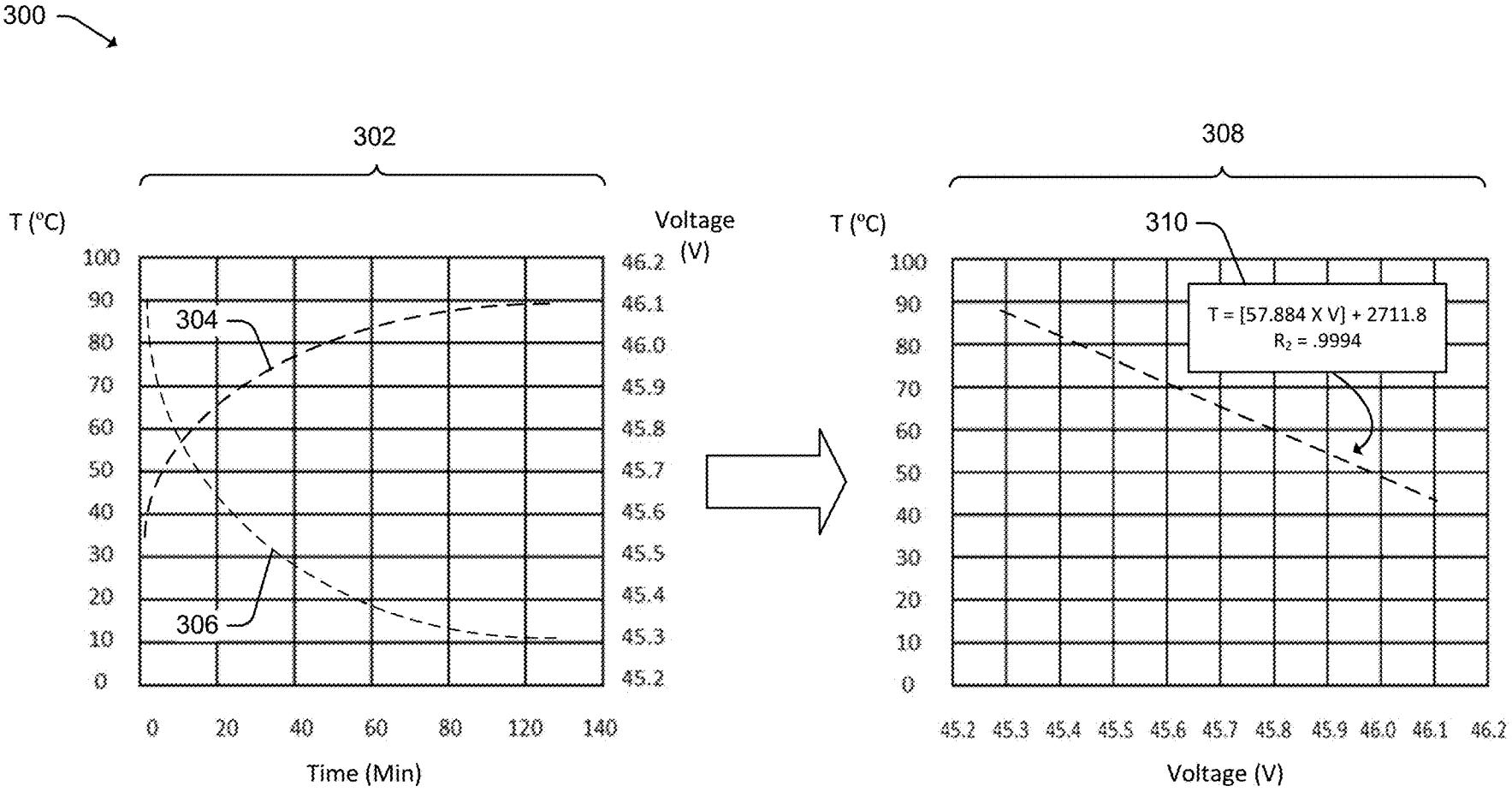
FIG. 3 illustrates example characteristics of an LED for a given electrical current in accordance with one or more aspects.

FIG. 3 illustrates example characteristics 300 of an LED for a given electrical current in accordance with one or more aspects. The LED may, in some instances, correspond to the LED 106 of FIG. 1.

Chart 302 of FIG. 2 represents behavior of an LED for a given amount of an electrical current that activates the LED (e.g., illuminates the LED). The behaviors may be measured in a lab environment and may be associated with a specific LED bin. As illustrated, a junction-temperature behavior 304 indicates, for the given amount of electrical current, an increase in junction temperature of the LED over time. Also, as illustrated, a forward-voltage behavior 306 indicates that for the given amount of electrical current, a forward voltage realized by the LED decreases over the same time.

Chart 308 of FIG. 3, which is derivable by applying linear regression analysis to measured data quantifying the junction-temperature behavior 304 and the forward-voltage behavior 306, represents a forward-voltage characterization 310 of the LED. As illustrated, the forward-voltage characterization 310 defines, for the given amount of electrical current, an approximate linear relationship between a forward voltage and a junction temperature of the LED. The approximate linear relationship corresponds to the previously mentioned equation (1).

Figure 4:
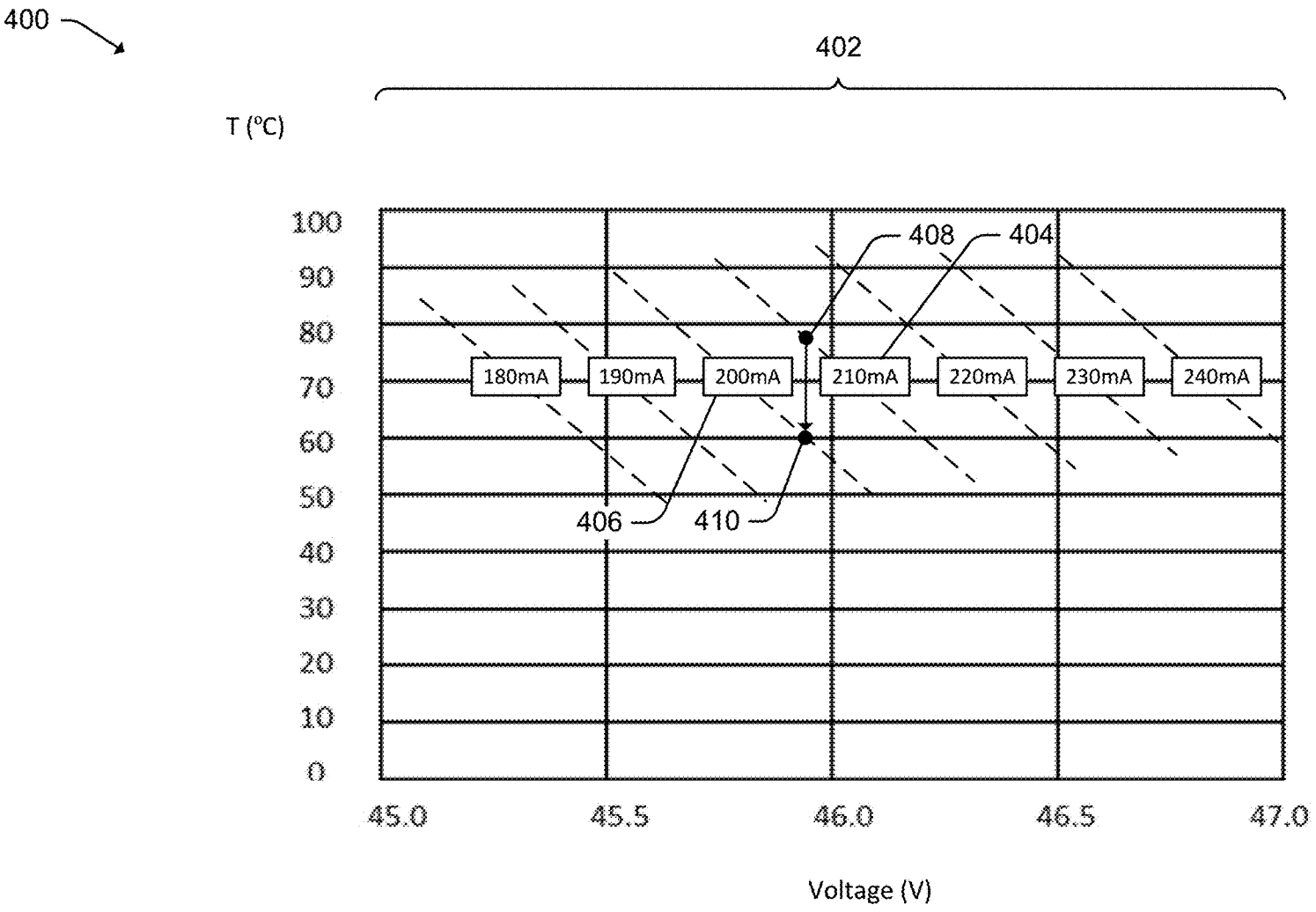
FIG. 4 illustrates example characteristics of a LED for multiple given amounts of an electrical current in accordance with one or more additional aspects.

FIG. 4 illustrates example characteristics 400 of an LED for multiple, given amounts of an electrical current in accordance with one or more aspects. The LED may, in some instances, correspond to the LED 106 of FIG. 1.

Chart 402 represents a plurality of example forward-voltage characterizations. A first forward-voltage characterization 404 corresponds to first amount (e.g., 210 mA) of the electrical current. A second forward-voltage characterization 406 corresponds to a second amount (e.g., 200 mA) of the electrical current.

In some instances, algorithms within a thermal-control manager application (e.g., the thermal-control manager application 114 of FIG. 1) may reference the plurality of forward-voltage characterizations to actively control thermal performance of a lighting system (e.g., the lighting system 102 of FIG. 1). For example, if a power supply of the lighting system (e.g., the power supply 108 of FIG. 1) is known to be providing an electrical current in an amount of 210 mA to an LED, and a forward-voltage is concurrently determined to be approximately 45.9V (e.g., as determined by the MCU 110 of FIG. 1, based on a conversion of the forward-voltage by the voltage-divider circuit 118 of FIG. 1), the thermal-control manager application may, based on a first forward-voltage characterization (e.g., the first forward-voltage characterization 404 for 210 mA), determine that a junction temperature of the LED equates to a first temperature 408 (e.g., 78° C.) that is detrimental to the LED. In such an instance, the thermal-control manager application may determine, for the amount of the electrical current (e.g., 210 mA), that the forward voltage is exceeding a threshold.

In response, and based on the plurality of forward-voltage characterizations, the thermal-control manager application may reference a second forward-voltage characterization (e.g., the second forward-voltage characterization 406 for 200 mA) and determine that reducing the current from 210 mA to 200 mA would lower the junction temperature of the LED to a second temperature 410 (e.g., 60° C.) that is not detrimental to the LED. The thermal-control manager application may then instruct the power supply to reduce the electrical current that it provides to the LED.

In general, algorithms within the thermal-control manager may, in accordance with equations (1)-(3), reference one or more forward-voltage characterizations to manage thermal-control of the lighting system. This may include, in some instances, applying one or more offsets to use as a guard band for one or more thresholds that may be associated with a forward voltage.

Furthermore, and in general, forward-voltage characterizations as described with reference to FIGS. 3 and 4, and as defined by equations (1)-(3), may apply to individual LEDs, arrays of LEDs, or combinations thereof. This may include one or more LEDs that are electrically coupled in series, parallel, or combinations thereof.

Example Method

Figure 5:
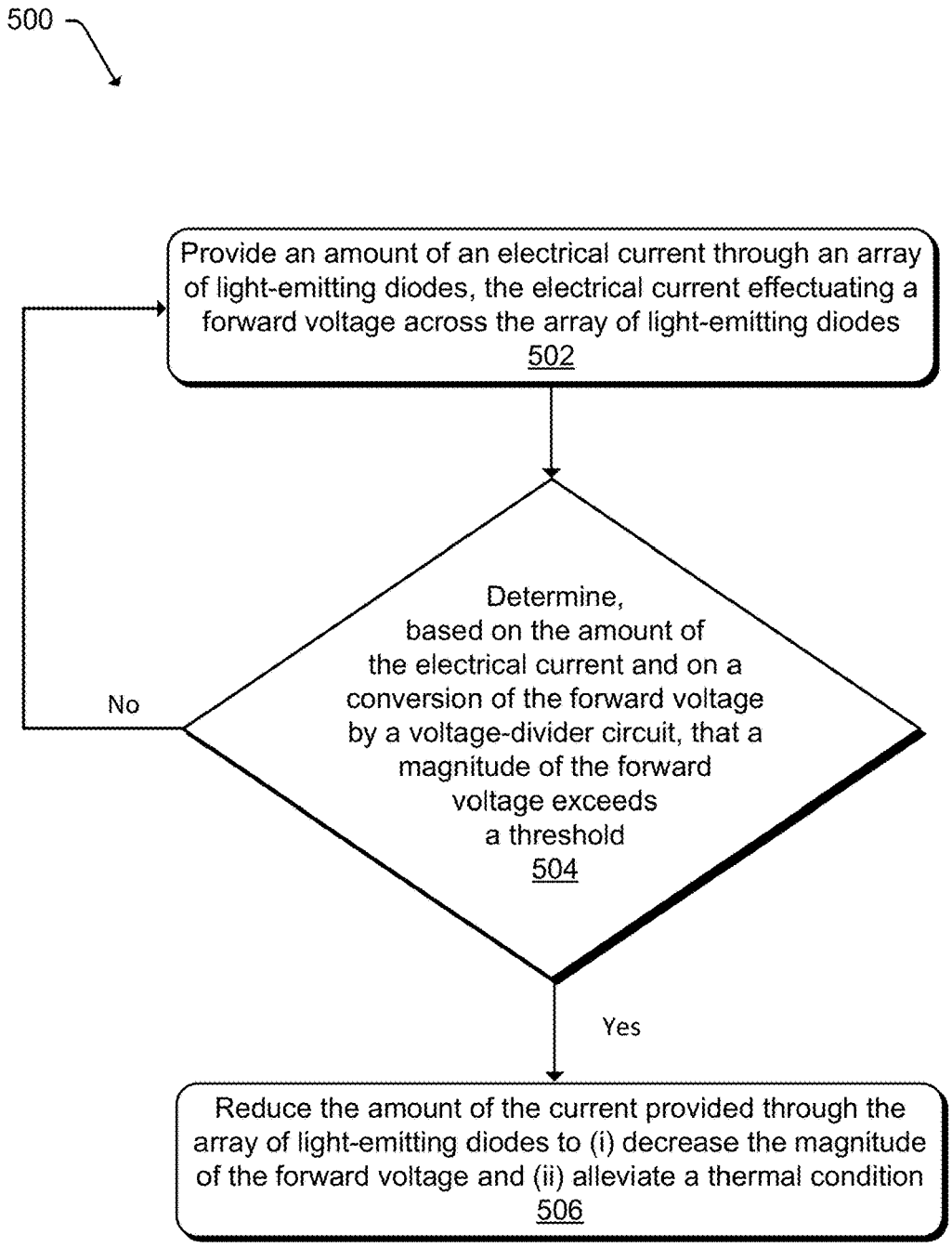
FIG. 5 illustrates an example method that uses virtual temperature-sensor techniques for active thermal-control of a lighting system having an array of LEDs.

FIG. 5 illustrates an example method 500 that uses virtual temperature-sensor techniques for active thermal-control of a lighting system having an array of LEDs. In some instances, the method 500 may be performed by a lighting system using the aspects of FIGS. 1-4. The described operations may be performed with other operations, in alternative orders, in fully or partially overlapping manners, and so forth.

At operation 502, the lighting system (e.g., the power supply 108 of the lighting system 102 of FIG. 1) provides an amount of an electrical current (e.g., the electrical current 124 of FIG. 1) through an array of LEDs (e.g., the LED array 104 of FIG. 1). The electrical current effectuates a forward voltage (e.g., the forward voltage 120 of FIG. 1) across the array of LEDs.

At operation 504, the lighting system (e.g., the MCU 110 executing the thermal-control manager application of 114) may determine, based on the amount of the electrical current and a conversion of the forward voltage by a voltage-divider circuit (e.g., the voltage-divider circuit 118 of FIG. 1), that a magnitude of the forward voltage exceeds a threshold. If the magnitude of the forward voltage does not exceed the threshold, the lighting system may continue to provide the amount of the electrical current through the array of LEDs without change.

In some instances, determining that the magnitude of the forward voltage exceeds the threshold may be based on a first forward-voltage characterization (e.g., the first forward-voltage characterization 404 of FIG. 4) of at least one light-emitting diode of the array of light-emitting diodes. The first forward-voltage characterization may define, for the amount of the electrical current, a first approximate linear relationship between the forward voltage and a junction temperature of the at least one light-emitting diode.

Furthermore, and in such instances, reducing the amount of electrical current may be based on a second forward-voltage characterization of the at least one light-emitting diode (e.g., the second forward-voltage characterization 406 of FIG. 4). The second forward-voltage characterization may define, for another amount of the current, a second approximate linear relationship between the forward voltage and the junction temperature of the at least one emitting diode.

In some other instances, determining the forward voltage exceeds a threshold may be based on a plurality of forward-voltage characterizations. In such instances, the plurality of forward-voltage characterizations may be for a plurality of light-emitting diodes included in the array of light-emitting diodes. Furthermore, the forward-voltage characterizations may define, for the amount of the electrical current, an approximate linear relationship between the forward voltage and a junction temperature for each of the light-emitting diodes included in the array of light-emitting diodes.

At operation 506, and in response to determining that the magnitude of the forward voltage exceeds the threshold, the lighting system may reduce the amount of the electrical current provided through the array of light-emitting diodes (e.g., the MCU 110 may direct the power supply 108 to reduce the electrical current 124). Reducing the electrical current may (i) decrease the magnitude of the forward voltage across the array of light-emitting diodes and (ii) alleviate a thermal condition that is proximate to the array of light-emitting diodes.

In general, and for the method 500, the threshold may include an offset to guard band the threshold. Furthermore, the method 500 may be varied to include different combinations of LED types and/or layouts. The method 500 may be extended to incorporate additional thermal condition detection techniques (e.g., include aspects of thermistors, and so on).

Although techniques using and apparatuses for active thermal-control of a lighting system having an array of LEDs are described above, it is to be understood that the subject of the appended claims is not necessarily limited to the specific features or methods described. Rather, the specific features and methods are disclosed as examples of ways in which active thermal-control of a lighting system having an array of LEDs can be implemented.

What is claimed is:

1. A method comprising:

receiving information indicative of an amount of an electrical current received at an array of light-emitting diodes, the amount of the electrical current effectuating a forward voltage across the array of light-emitting diodes;

determining, based on (i) the information received indicative of the amount of electrical current and (ii) a first forward-voltage characterization of at least one light-emitting diode of the array of light-emitting diodes, that a magnitude of the forward voltage exceeds a threshold, the first forward-voltage characterization indicative of a first correlation between the forward voltage and a junction temperature of the at least one light-emitting diode; and causing, in response to determining that the magnitude of the forward voltage exceeds the threshold, a reduction in the amount of the electrical current received at the array of light-emitting diodes to decrease the magnitude of the forward voltage and alleviate a thermal condition that is proximate to the array of light-emitting diodes.

2. The method as recited by claim 1, wherein determining that the magnitude of the forward voltage exceeds a threshold is further based on a conversion of the forward voltage by a voltage divider circuit.

3. The method as recited by claim 2, wherein the first correlation comprises a first approximate linear relationship between the forward voltage and the junction temperature of the at least one light-emitting diode.

4. The method as recited by claim 3, wherein the reduction in the amount of electrical current is based on a second forward-voltage characterization of the at least one light-emitting diode, the second forward-voltage characterization indicative of a second correlation, for another amount of the current, between the forward voltage and the junction temperature of the at least one light-emitting diode.

5. The method as recited by claim 2, wherein the conversion of the forward voltage is based on a voltage-divider circuit converting the forward voltage to a reduced voltage, the reduced voltage being at a detectable level within a predetermined range.

6. The method as recited by claim 5, wherein the conversion of the forward voltage is a linear conversion.

7. The method as recited by claim 1, wherein determining that the forward voltage exceeds a threshold is based on a plurality of forward-voltage characterizations, the plurality of forward-voltage characterizations being for light-emitting diodes comprising the array of light-emitting diodes.

8. The method as recited by claim 7, wherein the plurality of forward-voltage characterizations define, for the amount of the electrical current, an approximate linear relationship between the forward voltage and a junction temperature for each of the light-emitting diodes of the array of light-emitting diodes.

9. The method as recited by claim 1, wherein the threshold includes an offset to be used as a guard band.

10. A lighting system comprising:

an array of light-emitting diodes;

a non-transitory computer-readable storage medium having instructions therein; and at least one processor, responsive to executing the instructions, configured to:

receive information indicative of an amount of an electrical current received at the array of light-emitting diodes, the amount of the electrical current effectuating a forward voltage across the array of light-emitting diodes;

determine, based on (i) the information received indicative of the amount of electrical current and (ii) a first forward-voltage characterization of at least one light-emitting diode of the array of light-emitting diodes, that a magnitude of the forward voltage exceeds a threshold, the first forward-voltage characterization indicative of a first correlation between the forward voltage and a junction temperature of the at least one light-emitting diode; and cause, in response to the determination that the magnitude of the forward voltage exceeds a threshold, a reduction in the amount of the electrical current received at the array of light-emitting diodes to decrease the magnitude of the forward voltage and alleviate a thermal condition that is proximate to the array of light-emitting diodes.

11. The lighting system as recited in claim 10, wherein the array of light-emitting diodes comprises a plurality of light-emitting diodes forming an electrical series.

12. The lighting system as recited in claim 11, wherein each of the plurality of light-emitting diodes conforms to a common bin.

13. The lighting system as recited in claim 11, wherein the array of light-emitting diodes includes a first light-emitting diode that conforms to a first bin and a second light-emitting diode that conforms to a second bin.

14. The lighting system as recited in claim 10, wherein the array of light-emitting diodes includes at least one organic light-emitting diode.

15. The lighting system as recited in claim 10, wherein the array of light-emitting diodes includes at least one gallium-nitride light-emitting diode.

16. The lighting system as recited in claim 10, wherein the at least one processor and the computer-readable storage medium are included on a system-on-chip integrated circuit device.

17. The lighting system as recited by claim 10, wherein the lighting system is a floodlight, a backlight for a television monitor, a headlamp for an automobile, or a streetlight.

18. A non-transitory computer-readable storage medium storing one or more programs, the one or more programs comprising thermal-control manager application including executable instructions, which when executed by a processor, cause the processor to perform operations comprising:

receiving information indicative of an amount of an electrical current received at an array of light-emitting diodes, the amount of the electrical current effectuating a forward voltage across the array of light-emitting diodes;

determining, based on (i) the information received indicative of the amount of electrical current and (ii) a first forward-voltage characterization of at least one light-emitting diode of the array of light-emitting diodes, that a magnitude of the forward voltage exceeds a threshold, the first forward-voltage characterization indicative of a first correlation between the forward voltage and a junction temperature of the at least one light-emitting diode; and causing, in response to the determination that the magnitude of the forward voltage exceeds a threshold, a reduction in the amount of the electrical current received at the array of light-emitting diodes to decrease the magnitude of the forward voltage and alleviate a thermal condition that is proximate to the array of light-emitting diodes.

19. The non-transitory computer-readable storage medium as recited by claim 18, wherein the thermal-control manager application includes one or more algorithms that are based on a forward-voltage characterization of at least one light-emitting diode of the array of light-emitting diodes.

20. The non-transitory computer-readable storage medium as recited by claim 19, wherein the one or more algorithms are further based on a transient thermal-response behavior of a lighting system that includes the array of light-emitting diodes.

* * * * *